US008597136B1

(12) United States Patent
Grossbard

(10) Patent No.: US 8,597,136 B1
(45) Date of Patent: Dec. 3, 2013

(54) TECHNIQUE-CORRECTING GOLF PUTTER

(71) Applicant: Steven Grossbard, Beverly Hills, CA (US)

(72) Inventor: Steven Grossbard, Beverly Hills, CA (US)

( * ) Notice: Subject to any disclaimer, the term of this patent is extended or adjusted under 35 U.S.C. 154(b) by 0 days.

(21) Appl. No.: 13/791,158

(22) Filed: Mar. 8, 2013

(51) Int. Cl.
*A63B 53/04* (2006.01)

(52) U.S. Cl.
USPC ..... 473/325; 473/329; 473/340

(58) Field of Classification Search
USPC ..... 473/324–350
See application file for complete search history.

(56) References Cited

U.S. PATENT DOCUMENTS

| | | | | | |
|---|---|---|---|---|---|
| 2,222,534 | A | * | 11/1940 | Harris | 473/248 |
| D201,811 | S | * | 8/1965 | Kroll | D21/738 |
| 4,253,667 | A | * | 3/1981 | Clark et al. | 473/325 |
| 5,456,464 | A | * | 10/1995 | Davenport et al. | 473/251 |
| 5,816,931 | A | * | 10/1998 | Schooler | 473/248 |
| 5,993,324 | A | * | 11/1999 | Gammil | 473/251 |
| 6,056,647 | A | * | 5/2000 | Tingelstad | 473/307 |
| D486,540 | S | * | 2/2004 | Bettinardi | D21/738 |
| D486,541 | S | * | 2/2004 | Bettinardi | D21/738 |
| D496,972 | S | * | 10/2004 | Higbee | D21/736 |
| D500,539 | S | * | 1/2005 | Holloway | D21/736 |
| 6,958,019 | B2 | * | 10/2005 | Rohrer | 473/324 |
| 6,988,956 | B2 | * | 1/2006 | Cover et al. | 473/244 |
| D521,088 | S | * | 5/2006 | Mercier | D21/736 |
| 7,077,758 | B2 | * | 7/2006 | Rohrer | 473/251 |
| 7,264,557 | B1 | * | 9/2007 | Grossbard | 473/325 |
| 7,396,292 | B1 | * | 7/2008 | Grossbard | 473/325 |
| D595,370 | S | * | 6/2009 | Ines et al. | D21/736 |
| 8,251,836 | B2 | * | 8/2012 | Brandt | 473/340 |

FOREIGN PATENT DOCUMENTS

| | | | | |
|---|---|---|---|---|
| JP | 2005211613 | A | * 8/2005 | A63B 53/04 |
| JP | 2007307334 | A | * 11/2007 | |

* cited by examiner

*Primary Examiner* — Alvin Hunter
(74) *Attorney, Agent, or Firm* — Cislo & Thomas, LLP

(57) ABSTRACT

A golf putter having a shaft and a putting head connected to the shaft, where the putting head is configured with one or more flat faces to emit different sounds depending on whether the golfer has hit the sweet spot of the putter. In addition, the putter may have concave faces as an alternative means for training the golfer to hit the sweet spot of the putter.

17 Claims, 5 Drawing Sheets

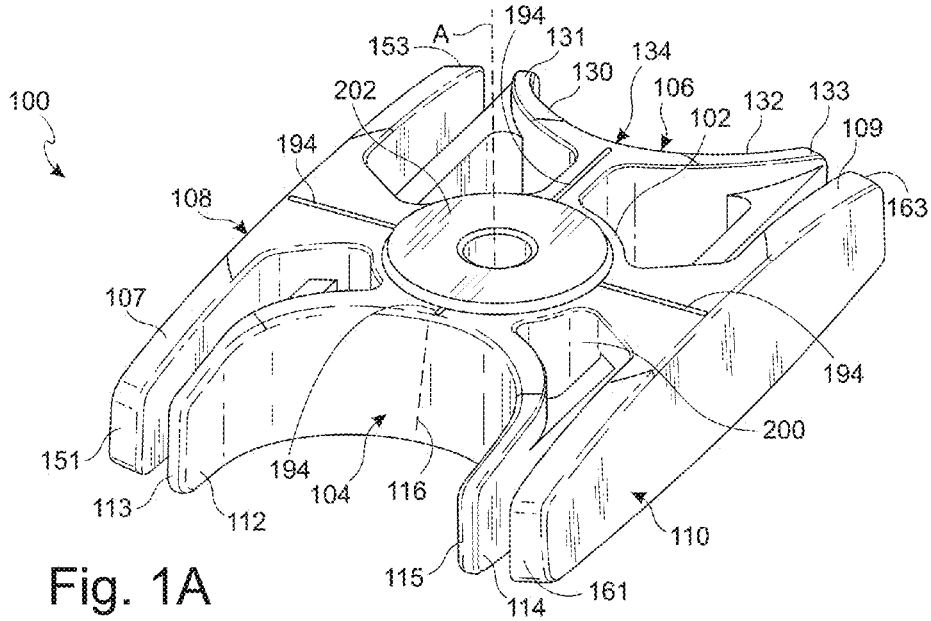
Fig. 1A
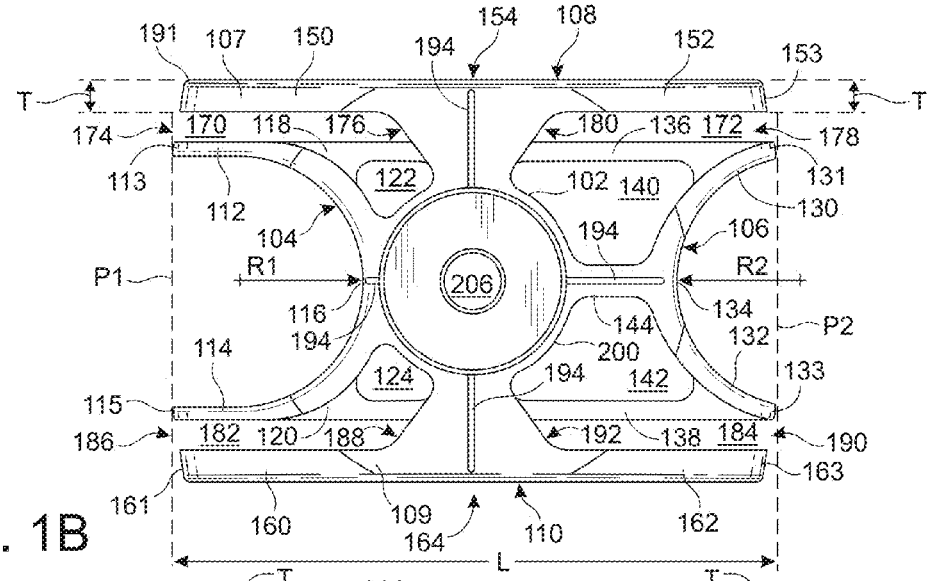
Fig. 1B
Fig. 1C

TECHNIQUE-CORRECTING GOLF PUTTER

TECHNICAL FIELD

This invention relates to putters to help improve putting techniques. More particularly, the putter is configured to help the golfer hit the sweet spot on the putter.

BACKGROUND OF THE INVENTION

One of the more difficult aspects of playing the game of golf is how to properly make putts, and one of the critical aspects of making a putt is proper contact between the golf putter and the golf ball. As such, there is a need for a golf putter to help ensure proper contact with the golf ball.

In addition, there is a need for a versatile putter that can be used by any user of any size, whether left handed or right handed.

BRIEF SUMMARY OF INVENTION

The present invention is directed to a golf putter having a shaft and a putting head connected to the shaft, where the putting head is configured to help the golfer hit the sweet spot on the putter.

In one aspect of the invention, the putter has a pair of oppositely facing curved contact faces and a pair of oppositely facing flat contact faces.

In another aspect of the invention, the putter comprises voids configured so as to create a "ping" or ringing sound when the golf ball does not hit the sweet spot of one of the flat contact faces. Hitting the sweet spot may create a ringing sound of a different pitch or may create a dull, non-ringing sound or light thud.

With the plurality of contact faces, the putter of the present invention is also versatile so that it can be used by left and right hand putters.

In another aspect of the invention, the putter comprises a movable or adjustable shaft to improve the versatility of the putter. For example, the shaft may be removable from the putter so as to be replaced or interchanged with a different shaft, the shaft may be capable of toggling about a transverse axis relative to the putter to change the angle of the shaft to the top surface of the putter, the shaft may be rotatable about an axis perpendicular to the top surface, or any combination thereof.

BRIEF DESCRIPTION OF THE DRAWINGS

FIG. 1A is a perspective view of an embodiment of the current invention.

FIG. 1B is a top view of the embodiment shown in FIG. 1A.

FIG. 1C is an elevation view of the embodiment shown in FIG. 1A.

DETAILED DESCRIPTION OF THE INVENTION

Figure 2A:
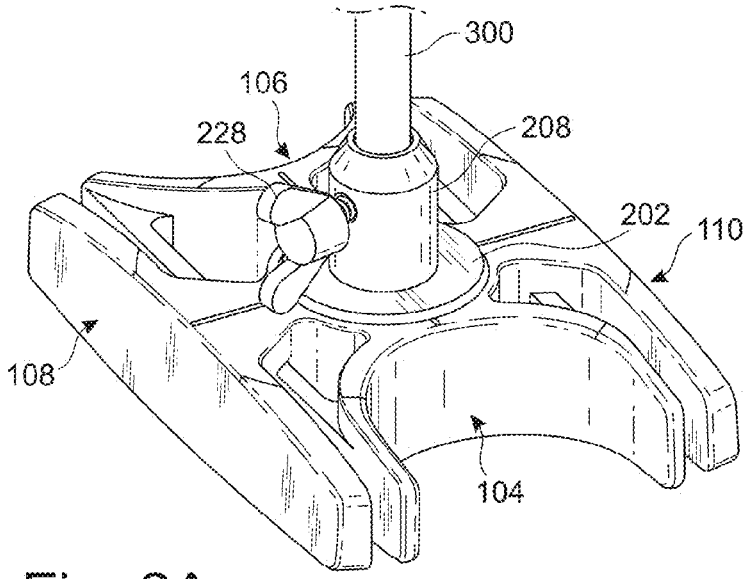
FIG. 2A is a perspective view of another embodiment of the current invention.

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

FIGS. 1A-1C show a golf putter 100 comprising a base 102 and a plurality of contact faces 104, 106, 108, 110 attached to the base 102. In the preferred embodiment, the putter 100 comprises a first curved contact face 104, a second curved contact face 106 opposite the first curved contact surface 104, a first flat plate 107 having a first flat contact face 108 adjacent to the first and second curved contact faces 104, 106, and a second flat plate 109 having a second flat contact face 110 opposite the first flat contact face 108 and adjacent to the first and second curved contact faces 104, 106.

In the preferred embodiment, the first curved contact face 104 has a radius of curvature that is similar to that of a standard golf ball to help teach the golfer to swing the putter in a straight path. It is understood by those skilled in the art that a golf ball has a diameter of about 1.68 inches (42.67 mm); so the radius of a golf ball is about 0.84 inches (21.34 mm). Any deviation from a straight path swing will be evident when using this putter. For example, if the face of the putter is rotated so as to deviate from a straight path the putter will not receive the golf ball properly.

In one embodiment the first curved contact face 104 may be partially-spherical or partially-cylindrical. The first curved contact face 104 further comprises a first radius R1, a first curved arm portion 112 terminating at a first terminal end 113, a second curved arm portion 114 terminating at a second terminal end 115, a first apex 116 connecting the first curved arm portion 112 to the second curved arm portion 114, and a first depth D1 measured from the first apex 116 to a first plane P1 defined by the first terminal end 113 and the second terminal end 115.

Preferably, the first radius R1 can be at least the same measurement as a standard, regulation golf ball radius. The first radius R1 can also be greater than the radius of a golf ball so as to decrease the degree of the curvature of the first contact face 104. In the preferred embodiment, the first radius R1 is approximately one inch. The first apex 116 is defined as an imaginary vertical line along the first curved contact face 104 that is the farthest away from the first plane P1 created by the first terminal end 113 and the second terminal end 115 of the first curved contact face 104, where the distance is measured orthogonal to the first plane P1.

The first depth D1 is defined as a distance between the first apex 116 and the first plane P1. In the preferred embodiment, the first depth D1 on the first curved contact face 104 can range from approximately one-half the radius of a golf ball to about the diameter of a golf ball. In some embodiments, the first depth D1 on the first curved contact face 104 can be about the same measurement as the radius of a golf ball.

In the preferred embodiment, the first curved contact face 104 is connected to the base 102 approximately at the first apex 116. The first curved contact face 104 may be reinforced with stabilization bars 118, 120. A first stabilization bar 118 may connect the first terminal end 113 on the first curved arm portion 112 to the base 102. The first stabilization bar 118 is connected to the first terminal end 113 and the base 102 in a way so as to create or define a first void 122.

A second stabilization bar 120 may connect the second terminal end 115 on the second curved arm portion 114 to the base 102. The second stabilization bar 120 may be connected to the second terminal end 115 and the base 102 in a way so as to create or define a second void 124.

The second curved contact face 106 is on the opposite side of the base 102 relative to the first curved contact face 104 and may be partially-spherical or partially-cylindrical. The second curved contact face 106 comprises a second radius R2, a third curved arm portion 130 terminating at a third terminal end 131, a fourth curved arm portion 132 terminating at a fourth terminal end 133, a second apex 134 connecting the third curved arm portion 130 to the fourth curved arm portion 132, and a second depth D2 defined as the distance from the second apex 134 to a second plane P2 defined by the third terminal end 131 and the fourth terminal end 133. In the preferred embodiment, the second radius R2 can be at least the same measurement as the golf ball radius. The second radius R2 can also be greater than the radius of a golf ball so as to decrease the degree of the curvature of the second curved contact face 106. The second apex 134 is defined as an imaginary vertical line along the second curved contact face 106 that is the farthest away from a second plane P2 created by the third terminal end 131 and the fourth terminal end 133 on the second curved contact face 106.

The second depth D2 is defined as the shortest distance between the second apex 134 and the second plane P2. The second depth D2 of the second curved contact face 106 can range from approximately one-half the radius of a golf ball to approximately the diameter of a golf ball. In some embodiments, the second depth D2 of the second curved contact face 106 may be the same measurement as the radius of a golf ball.

In the preferred embodiment, the second curved contact face 106 is connected to the base 102 at approximately the second apex 134. The second curved contact face 106 may be reinforced with stabilization bars 136, 138. A third stabilization bar 136 may connect the third terminal end 131 to the base 102. The third stabilization bar 136 is connected to the third terminal end 131 and the base 102 in a way so as to create or define a third void 140. In some embodiments, the second curved contact face 106 may be connected to the base 102 by a stem 144.

A fourth stabilization 138 may connect the fourth terminal end 133 to the base 102. The fourth stabilization bar 138 may connect the fourth terminal end 133 to the base 102 in such a way so as to create or define a fourth void 142.

The first and second flat contact faces 108, 110 are adjacent to the first and second curved contact faces 104, 106, and on opposite sides of the base 102. The first flat contact face 108 is defined by the first flat plate 107 having a first straight arm portion 150, a second straight arm portion 152 opposite the first straight arm portion 150, and a first middle portion 154 connecting the first straight arm portion 150 to the second straight arm portion 152. The first flat plate 107 may be connected to the base 102 at the first middle portion 154. The first middle portion 154 defines a first sweet spot on the putter 100. The first flat plate 107 is arranged parallel to the first and third stabilization bars 118, 136. However, the first and second straight arm portions 150, 152 of the first flat plate 107 are not connected to the first and third terminal ends 113, 131 on the first and second curved contact faces 104, 106, respectively. Therefore, the first and second straight arm portions 150, 152 terminate as first and second free ends 151, 153.

Since the first flat plate 107 is parallel to the first and third stabilization bars 118, 136, a first channel or elongated gap 170 is created in between the first straight arm portion 150 and the first stabilization bar 118, and a second channel or elongated gap 172 is created between the second straight arm portion 152 and the third stabilization bar 136. Therefore, the first straight arm portion 150 and the first stabilization bar 136 create a U-shaped configuration that functions like a tuning fork, the U-shaped configuration having a first open end 174 and a first closed end 176 opposite the first open end 174, wherein the first closed end 176 is attached to the base 102.

The elongated gap 172 defined by the second straight arm portion 152 and the third stabilization bar 136 create a similar U-shaped configuration having a second open end 178 and a second closed end 180 attached to the base 102. The first and second closed ends 176, 180 of each elongated gaps 170, 172 are adjacent to each other.

Similarly, the second flat contact face 110 is defined by the second flat plate 109 having a third straight arm portion 160, and a fourth straight arm portion 162 opposite the third straight arm portion 160, and a second middle portion 164 connecting the third straight arm portion 160 with the fourth straight arm portion 162. The second flat plate 109 may be connected to the base 102 at the second middle portion 164. The second middle portion 164 defines a second sweet spot. The second flat plate 109 is arranged parallel to the second and fourth stabilization bars 120, 138. However, the third and fourth straight arm portions 160, 162 on the second flat plate 109 are not connected to the second and fourth terminal ends 115, 133 of the first and second curved contact faces 104, 106, respectively. Therefore, the third and fourth straight arm portions 160, 162 terminate in third and fourth free ends 161, 163.

Since the second flat plate 109 is parallel to the second and fourth stabilization bars 120, 138 a third channel or elongated gap 182 is created in between the third straight arm portion 160 and the second stabilization bar 120, and a fourth channel or elongated gap 184 is created between the fourth straight arm portion 162 and the fourth stabilization bar 138. Therefore, the third straight arm portion 160 and the second stabilization bar 120 create a U-shaped configuration that functions like a tuning fork, the U-shaped configuration having a third open end 186 and a third closed end 188 opposite the third open end 186, wherein the third closed end 188 is attached to the base 102.

The fourth straight arm portion 162 and the fourth stabilization bar 138 create a similar U-shaped configuration having a fourth open end 190 and a fourth closed end 192 attached to the base 102. The third and fourth closed ends 188, 192 of each U-shaped configuration are adjacent to each other.

Due to the arrangement of the first, second, third, and fourth elongated gaps 170, 172, 182, 184, the golf putter 100 of the present invention creates a resonating "ping" sound when the putter 100 is not hit on one of its sweet spots on one of the flat contact surfaces 108, 110. The sweet spot on any contact surface is the direct center of the contact face. In the flat contact faces 108, 110, the sweet spot is located at the midpoint between the free ends 151, 153 and 161, 163. In the curved contact faces the sweet spot is located at the apex 116, 134. In some embodiments, the sweet spot may be demarcated with an indicator 194. The indicator 194 may be any marking or etching on the contact face or on the top surface 202 directly above the sweet spot.

Since the sweet spot is essentially connected to the base 102, hitting any of the sweet spots creates a dull thud-type sound, rather than a resonating ping sound. Therefore, the user will know that he has hit the sweet spot. If the user hears the resonating ping sound, the user will know that he missed the sweet spot.

The base 102 serves as a foundation onto which the contact surfaces 104, 106, 108, 110 can be connected. A shaft 300 may also be connected to the putter 100 at the base 102. The base 102 can be any shape. In the preferred embodiment, the base 102 is cylindrical having a wall 200, a top surface 202 connected to the wall 200, and a bottom surface 204 opposite the top surface 202 and connected to the wall 200.

The shaft 300 may be connected to the putter 100 at the top surface 202. Preferably, the shaft 300 is attached to the putter 100 in a way that would facilitate the ability of a user to use any of the contact faces 104, 106, 108, 110 as discussed in U.S. Pat. Nos. 7,264,557 and 7,396,292 and incorporated in their entirety here by this reference. For example, in one embodiment, the shaft 300 is connected orthogonal to the top surface 202 via an attachment hole 206. Having the shaft 300 orthogonal to the top surface 202 creates a symmetry that allows the golfer to putt with any of the contact surfaces 104, 106, 108, 110 merely by rotating the golf putter in 90 degree increments about the main axis A, which is perpendicular to the top surface 202.

Figure 2B:
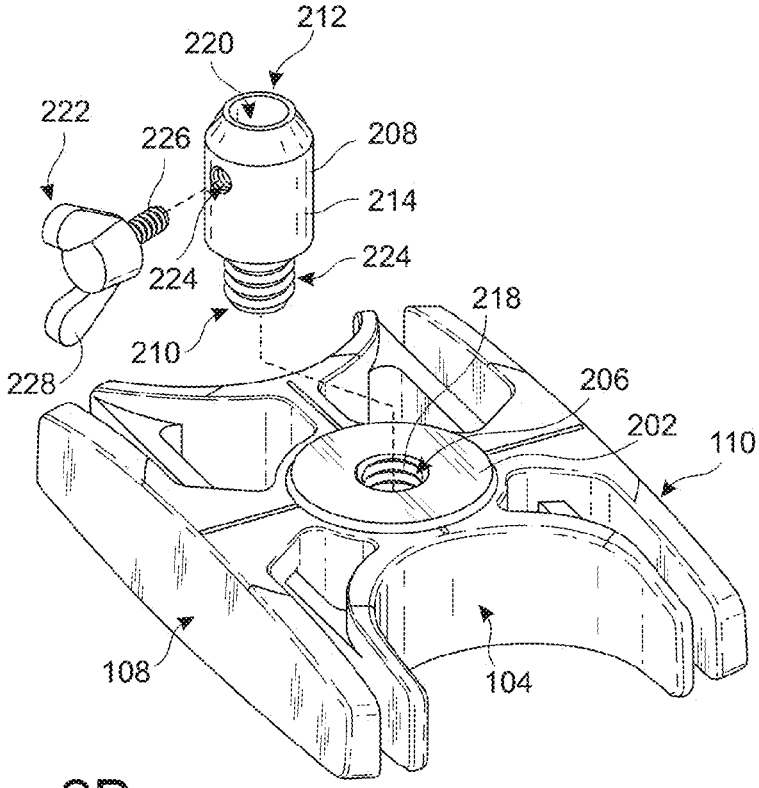
FIG. 2B is an exploded view of the embodiment shown in FIG. 2A.
Figure 2C:
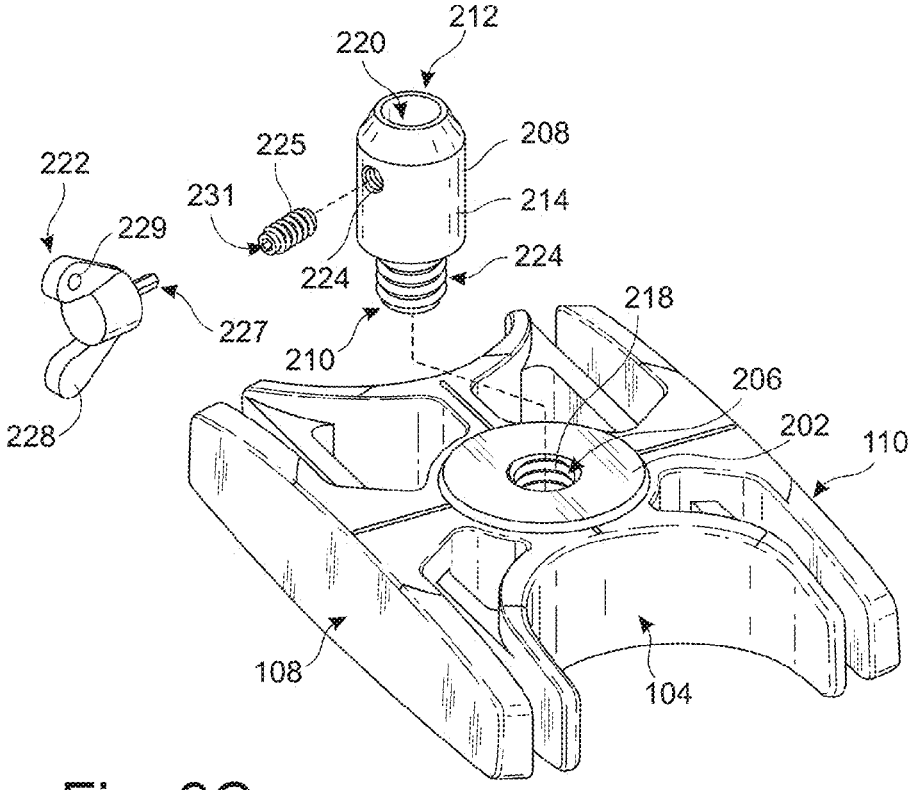
FIG. 2C is an exploded view of the embodiment shown in FIG. 2A, but with a different type of shaft securing fastener.

In some embodiments, the putter 100 of the present invention, or any putter, may comprise a movable shaft for improving the versatility of the putter. For example, the movable shaft 300 may be removable the putter head, capable of toggling back and forth, or capable of rotating about an axis perpendicular to the top surface 202 of the putter head. In one embodiment, the putter may comprise an insert 208 attached to the top surface 202 of the base 102 as shown in FIGS. 2A and 2B. The insert 208 maybe integrally formed with the base 102, fixed to the base 102, or removably attached to the base 102. The insert 208 may be a cylindrical device having an insertion end 210 and a receiving end 212 opposite the insertion end 210 and a cylindrical wall 214 there between. The insertion end 210 may be inserted into the base 102 for secure attachment. In embodiments in which the insert 208 is removably attached to the base 102, the insertion end 210 may be threaded and the base 102 may have an orifice 216 with reciprocal threading 218 to receive the insertion end 210.

The receiving end 212 of the insert 208 may have an orifice 220 to receive the shaft 300. The cylindrical wall 214 may comprise a fastener 222 to secure the shaft 300 inside the orifice 220. For example, the cylindrical wall 214 may have a threaded hole 224. A threaded bolt 226 attached to a wingnut 228 can be used to advance the threaded bolt 226 through the hole 224. With the shaft 300 inside the orifice 220, as the threaded bolt 226 passes through the hole 224, it will eventually make contact with the shaft 300. Continued advancement will apply pressure to the shaft 300 thereby preventing the shaft 300 from being removed. This type of fastener will allow the putter 100 to be used with many different types of straight shafts and bent shafts. Many other types of fastening mechanisms can be used.

For example, in some embodiments, the user may find that the wingnut 228 obstructs his view of the putter 100 while putting. Therefore, a set screw 225, such as a blind or headless set screw may be inserted into the threaded hole 224. The set screw 225 may have a hex socket 231. The wingnut 228 may comprise an alien wrench 227 to fit the hex socket 231 so that the wingnut 228 can drive the set screw 225 into the threaded hole 224 to secure the shaft 300 to the insert 208. The set screw 225 maybe dimensions so that it is nearly flush or housed within the threaded hole 224 when the shaft is secured or minimally protruding from the threaded hole 224. This eliminates or reduces the obstruction caused by the set screw 225. In some embodiments, the wingnut 228 may have a through-hole 229 through which a keychain or the like can be inserted so that the wingnut 228 can be carried and easily located. Having a shaft 300 removable improves the versatility of the putter by allowing different shafts of varying shapes (e.g. bent shafts, straight shafts, curved shafts, and the like), and sizes (e.g. men's sizes, women's sizes, children's sizes, and the like) to be used with the same putter head.

Figure 3:
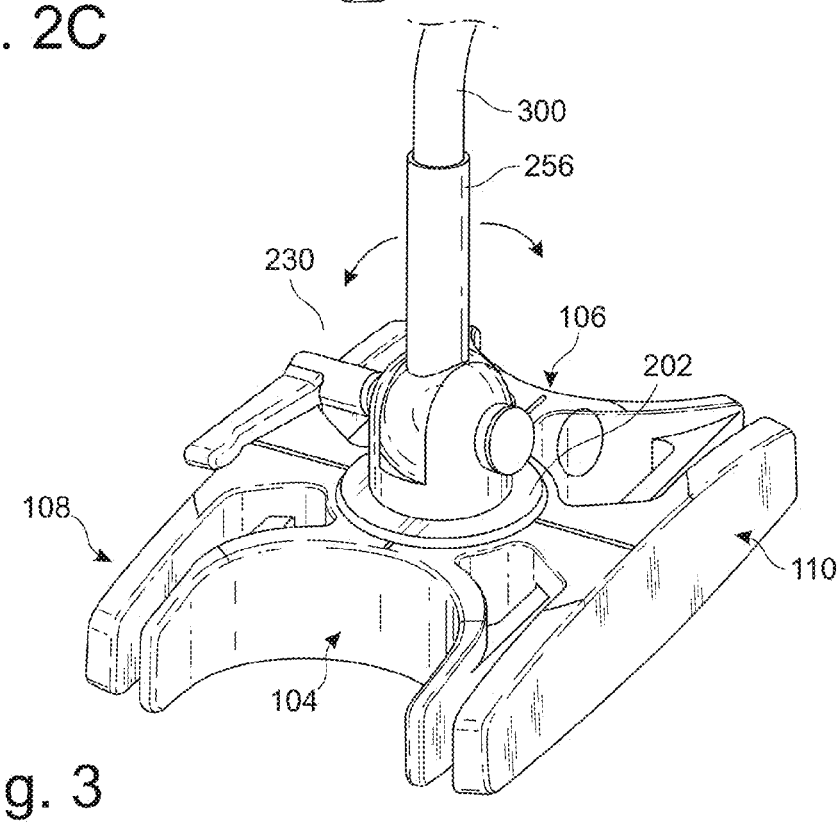
FIG. 3 is a perspective view of another embodiment of the current invention.

Alternatively, the shaft 300 may be adjustably attached to the top surface 202, such that the shaft 300 can be flipped, toggled, or shifted from a first position to a second position such that in the first position one contact face can be used and in the second position, the opposite contact face can be used as shown in FIG. 3. The shaft 300 can be secured in place by a fastener, such as a quick release locking mechanism 230, or any other fastening mechanism known in the art for locking movable shafts in place.

Figure 4A:
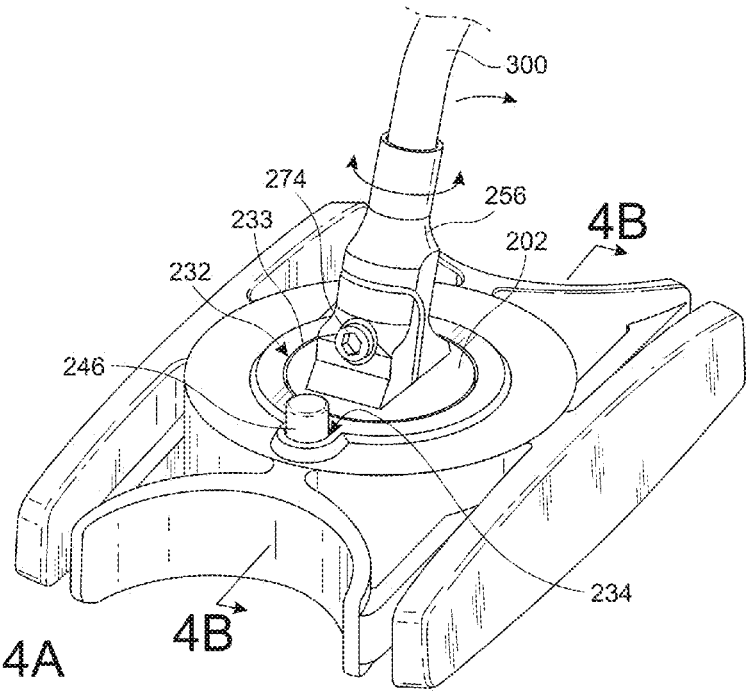
FIG. 4A is a perspective view of another embodiment of this invention.
Figure 4B:
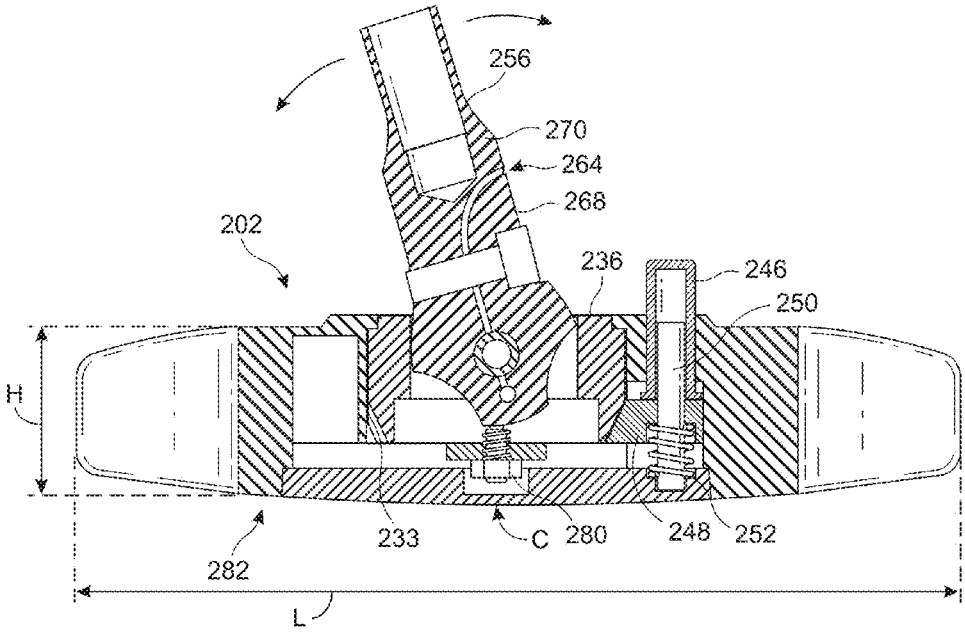
FIG. 4B is a cross-sectional view of the embodiment shown in FIG. 4A through line 4B-4B.
Figure 4C:
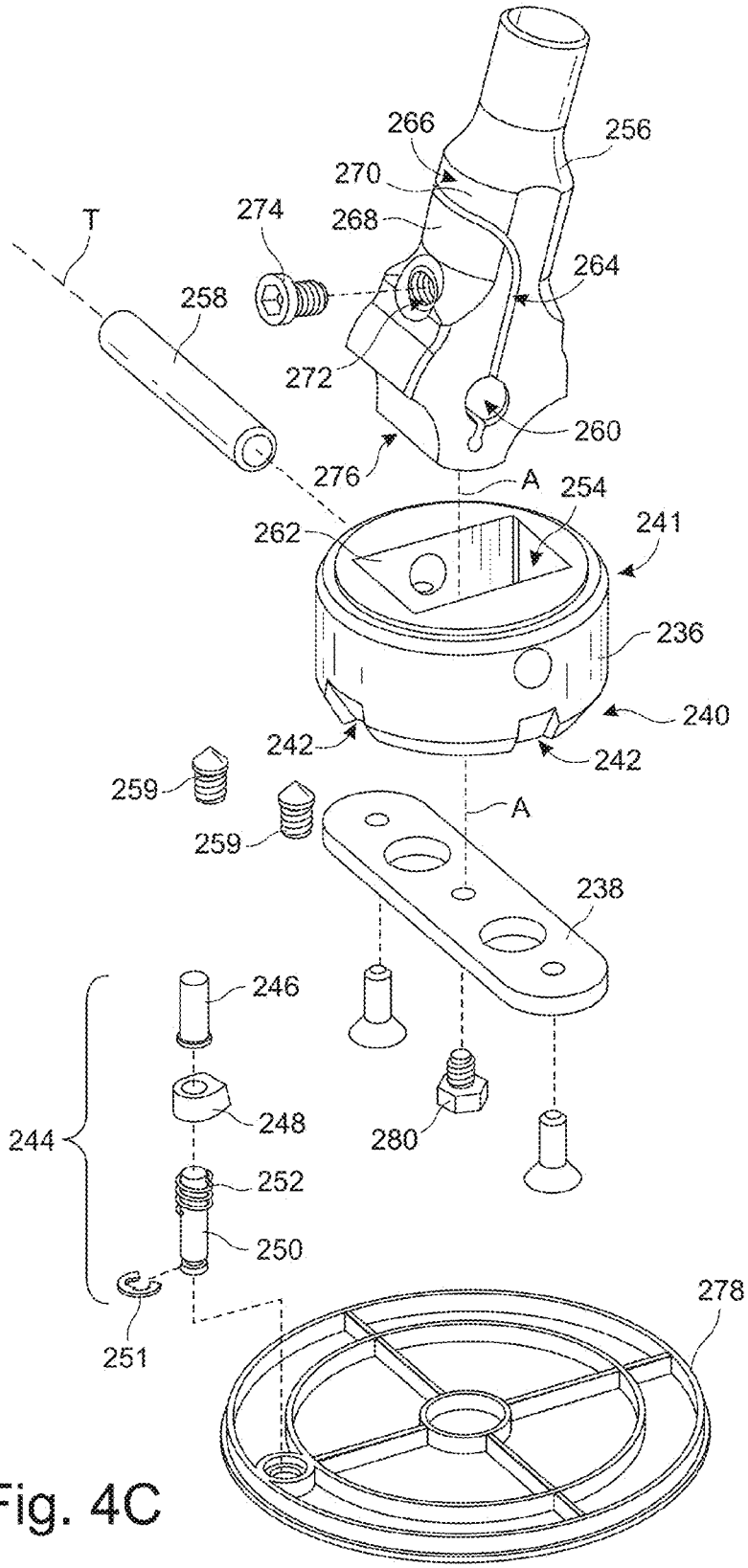
FIG. 4C is an exploded view of the embodiment shown in FIG. 4A.

In another embodiment, as shown in FIGS. 4A-4C, the shaft 300 may be rotatably coupled to the top surface 202 so that a user can rotate the shaft 300 to select a desired contact face for use. For example, the shaft 300 can rotate or swivel about an axis A perpendicular to the top surface 202. This will allow the user to merely turn or rotate the shaft 300 relative to the putter 100 to use any contact face without having to remove the shaft 300 from the putter 100. The shaft 300 can be secured in place either through a locking mechanism, or any other mechanism known in the art for locking movable shafts in place.

For example, in one embodiment the base 202 may have a main hole 232 defined by the inner wall 233 of the base 202 and an auxiliary hole 234 adjacent to the main hole 232. The main hole 232 may be circular defining a central axis A. A cylindrical hub 236 is configured to fit inside the main hole 234 in a rotatable manner so as to rotate about the central axis A. The cylindrical hub 236 may sit on a support plate 238 to facilitate rotational movement. At the bottom end 240 of the cylindrical hub 236 are a plurality of notches 242 separated circumferentially about the cylindrical hub 236, preferably at 90 degree intervals. A release mechanism 244 is housed in the auxiliary hole 234. The release mechanism 244 may comprise a button 246, a latch 248 movable by the button 246, a pin 250 upon which the latch 248 and button 246 can be mounted, a compression spring 252 wrapped about the pin 250 to create a biasing force against the latch 248, and a clip 251 to secure the pin 250. In the resting state, the latch 248 abuts against the cylindrical hub 236. When the cylindrical hub 236 is oriented relative to the latch 248 with one of the notches 242 facing the latch 248, the latch 248 can be wedged inside the notch 242, thereby preventing the cylindrical hub 236 from rotating. Depression of the button 246 forces the latch 248 to move in a downward direction thereby compressing the spring 252. The downward motion of the latch 248 removes the latch 248 from the notch 242 thereby allowing the cylindrical hub 236 to rotate about the central axis A. Upon release of the button 246, the latch 248 presses against the smooth wall of the cylindrical hub 236 but still allows the cylindrical hub 236 to rotate about the central axis A. When the next notch 242 approaches the latch 248, eventually the latch 248 will wedge into the notch 242 and lock the cylindrical hub 236 in place at its new orientation 90 degrees from the previous notch 242. This can continue so that the cylindrical hub 236 can rotate a full 360 degrees.

At the top 241 of the cylindrical hub 236 is a cutout 254 that goes through the bottom 240 of the hub 236. A shaft receiver 256 can be placed inside the cutout 254 and secured by a transverse pin 258. The transverse pin 258 may be secured to the hub 236 by set screws 259. The shaft receiver 256 may have a through-hole 260 through which the transverse pin 258 can be inserted and attached to the inner wall 262 of the cylindrical hub 236. The transverse pin 258 is cylindrical thereby allowing the shaft receiver 256 to rotate about the transverse axis T of the transverse pin 258. This allows the shaft receiver 256 to change angles relative to the top surface 202.

In some embodiments, the shaft receiver 256 may have a split 264 from the through-hole 260 to a surface 266 of the shaft receiver 256 creating a pair of clamp arms 268, 270. A threaded through-hole 272 may be created through the first clamp arm 268 into the second clamp arm 270. A nut 274 can be threaded into the through-hole 272 so as to close the split 264 thereby causing clamp arms 268, 270 to compress the transverse pin 258. This prevents the shaft receiver 256 from rotating about the pin 258. In order to change the angle of the shaft receiver 256, the user can unscrew the nut 274 releasing the pin 258 from the clamping action of the clamping arms 268, 270 thereby providing room for the shaft receiver 256 to rotate about the pin 258. This embodiment allows a shaft 300 to be rotated about a central axis A or toggled back and forth about a transverse axis T perpendicular to the central axis A.

In some embodiments, the bottom 276 of the shaft receiver 256 may be serrated. A bottom cover 278 may support a protrusion 280 directly underneath and abutted against the bottom 276 of the shaft receiver 256. The protrusion can interact with the serrated bottom 276 of the shaft receiver to create a stepped adjustment of the shaft receiver 256.

Although the means for making the shaft 300 movable or adjustable relative to the putter has been described with the putter 100 of the present invention, the means for making the shaft 300 movable or adjustable can be applied to any putters.

The sole 282 of the putter 100 is opposite the top surface 202. The sole 282 can be generally flat. In some embodiments, the sole 282 can be generally convex.

The distance between the top surface 202 and the sole 282, or height H, can be at least one-half the radius of a golf ball. In one embodiment the distance between the top surface 202 and the sole 282 is about the same measurement as a golf ball radius. In another embodiment the distance between the top surface 202 and the sole 282 is about the same measurement as a golf ball diameter. Since the diameter of a golf ball is about 1.68 inches (42.67 mm) and the radius of a golf ball is about 0.84 inches (21.34 mm), the distance between the top surface 202 and the sole 282, or the height H of the putter 100, can range from about 0.42 inches to about 1.68 inches. In the preferred embodiment, the height H of the putter 100 is approximately 1 inch. The distance from the first and second terminal ends 113, 115 on one curved contact face 104 to the third and fourth terminal ends 131, 133 of the other curved contact face 106, or the length L of the putter 100, can be from 4 inches to approximately 5.5 inches. Preferably, the length L of the putter is approximately 4.8 to 4.9 inches. The distance from one flat contact face 108 to the other flat contact face 110 through the center C, or the width W of the putter 100, ranges from 3 to 4 inches. Preferably, the width of the putter is approximately 3.2 inches to 3.3 inches. The thickness T of each of the flat plates 107, 109 is less that 0.75 inch. Preferably, the thickness T of each flat plate 107, 109 is less than 0.5 inch. In the most preferred embodiment, the thickness T is approximately 0.275 inch.

In a preferred embodiment, the distance from the center of one curved contact face 104 to the center C of the putter 100 may range from 1.5 to 2 inches. The distance from the center C of the putter 100 to the center of the first curved contact face 104 is approximately 1.5 to 2.5 inches. In a preferred embodiment, the distance from the center C of the putter 100 to the center of the first curved contact face 104 is approximately 1.9 inches. The distance from the center C of the putter 100 to the center of the second curved contact face 106 is approximately 2.5 to 3 inches. Preferably, the distance from the center C of the putter 100 to the center of the second curved contact face 106 is approximately 2.6 inches. The diameter of the base 102 may be approximately 1 inch to approximately 2 inches. Preferably, the diameter of the base 102 is approximately 1.5 inches.

In use, the user can putt with any contact face 104, 106, 108, 110. If using a straight shaft 300 inserted perpendicularly to the top surface 202, then the user merely rotates the putter 90 degrees increments to select the surface with which he desires to putt. If using a bent shaft, the user merely releases the shaft fastener and rotates the shaft 300 to the proper orientation to use any of the contact faces. In some embodiments, the user can release the locking mechanism 230 on the shaft receiver 256 to toggle the shaft 300 at angles ranging from 0° to 180° relative to the top surface 202. In some embodiments, the user can rotate the shaft receiver 256 to use the proper contact surface. In some embodiments, the user can toggle shaft 300 and rotate the shaft receiver 256 to get the precise orientation he wants.

The user can use the curved contact faces 104, 106 to help practice swinging the putter 100 in a straight line. With the curved contact faces 104, 106 the user can place the golf ball within the curved contact face and push the golf ball in the desired direction. If the swing a straight, the ball should go straight.

The user can use the flat surfaces 108, 110 to help identify the sweet spot. If the user misses the sweet spot, due to the elongated gaps 170, 172 or 182, 184 and free terminal ends 151, 153 or 161, 163 the putter will create a ringing or pinging sound. If the user hits the sweet spot, a different sound will be made.

The putter 100 of the present invention can be made from known methods with any hard material used in making golf putters. Preferably, the golf putter 100 is made of metal. More preferably, the putter 100 is made of aluminum or aluminum alloy. Most preferably, the putter 100 is made completely of metal or metal alloy without other non-metallic material that could absorb the vibrating capability of the metal or metal alloy. For example, the putter 100 should not comprise plastic or other non-metallic inserts, or should not comprise non-metallic inserts for other purposes, that could interfere with the pinging sound generated by the flat plates 107, 109 when a golf ball misses the sweet spot on the flat plates 107, 109. In some embodiments, the putter may be anodized. The anodized putter can also be dyed in a variety of different colors.

While the present invention has been described with regards to particular embodiments, it is recognized that additional variations of the present invention may be devised without departing from the inventive concept.

What is claimed is:

1. A golf putter, comprising:

(a) a base;

(b) a first curved contact face connected to the base, comprising:

(i) a first radius, (ii) a first curved arm portion, (iii) a second curved arm portion, (iv) a first apex, and (v) a first depth, wherein the first depth is defined as a distance between the first apex and a first plane defined by a first terminal end on the first curve arm portion and a second terminal end on the second curved arm portion;

(c) a second curved contact face connected to the base opposite the first curved contact face, comprising:
(i) a second radius,
(ii) a third curved arm portion,
(iii) a fourth curved arm portion,
(iv) a second apex, and
(v) a second depth, wherein the second depth is defined as a distance between the second apex and a second plane defined by a third terminal end on the third curved arm portion and a fourth terminal end on the fourth curved arm portion;

(d) a first flat plate having a first flat contact face, a first straight arm portion, a second straight arm portion opposite the first straight arm portion, and a first middle portion therebetween, the first straight arm portion adjacent to the first curved arm portion, the second straight arm portion adjacent to the third curved arm portion, and the first middle portion connected to the base;

(e) a second flat plate having a second flat contact surface, a third straight arm portion, a fourth straight arm portion opposite the third straight arm portion, and a second middle portion therebetween, the third straight arm portion adjacent to the second curved arm portion, the fourth straight arm portion adjacent to the fourth curved arm portion, and the second middle portion connected to the base opposite the first flat plate;

(f) a top surface; and (g) a sole opposite the top surface;

wherein the first straight arm portion, the second straight arm portion, the third straight arm portion, and the fourth straight arm portion terminate at a first free end, a second free end, a third free end, and a fourth free end, respectively.

2. The golf putter of claim 1, (a) wherein the first straight arm portion and the first curved arm portion define a first elongated gap therebetween;

(b) wherein the second straight arm portion and the third curved arm portion define a second elongated gap therebetween;

(c) wherein the third straight arm portion and the second curved arm portion define a third elongated gap therebetween; and (d) wherein the fourth straight arm portion and the fourth curved arm portion define a fourth elongated gap therebetween.

3. The golf putter of claim 1, (a) wherein the first curved contact surface, comprises:
(i) a first stabilization bar connecting the first terminal end on the first curved arm portion to the base, wherein the first elongated gap is defined by the first stabilization bar and the first straight arm portion, and
(ii) a second stabilization bar connecting the second terminal end on the second curved arm portion to the base, wherein the third elongated gap is defined by the second stabilization bar and the third straight arm portion; and (b) wherein the second curved contact surface, comprises:
(i) a third stabilization bar connecting the third terminal end to the base, wherein the second elongated gap is defined by the third stabilization bar and the second straight arm portion, and
(ii) a fourth stabilization bar connecting the fourth terminal end to the base, wherein the fourth elongated gap is defined by the fourth stabilization bar and the fourth straight arm portion.

4. The golf putter of claim 1, wherein a shaft is movably coupled to the base so that a user can use any of the contact faces.

5. The golf putter of claim 4, wherein the shaft is removably coupled to the base.

6. The golf putter of claim 5, further comprising an insert connected to the base, the insert comprising (a) a top orifice to receive the shaft, and (b) a fastener to secure the shaft into the top orifice.

7. The golf putter of claim 4, wherein the shaft is rotatably coupled to the base so that a golfer can rotate the shaft about a longitudinal axis perpendicular to the top surface to select a desired contact face for use.

8. The golf putter of claim 7, wherein the shaft is adjustably coupled to the top surface so that a golfer can toggle the shaft about a transverse axis perpendicular to the longitudinal axis from a first position to a second position.

9. The golf putter of claim 4, wherein the shaft is adjustably coupled to the top surface so that a golfer can toggle the shaft about a transverse axis perpendicular to the longitudinal axis from a first position to a second position.

10. A golf putter, comprising:

(a) a base;

(b) a first curved contact face connected to the base, the first curved contact face comprising a first curved arm portion terminating at a first terminal end, and a second curved arm portion terminating at a second terminal end;

(c) a second curved contact face connected to the base opposite the first curved contact face, the second curved contact face comprising a third curved arm portion terminating at a third terminal end, and a fourth curved arm portion terminating at a fourth terminal end;

(d) a first flat plate having a first flat contact face, a first straight arm portion terminating at a first free end, a second straight arm portion opposite the first straight arm portion, the second straight arm portion terminating at a second free end, and a first middle portion therebetween, the first middle portion connected to the body;

(e) a second flat plate having a second flat contact surface, a third straight arm portion terminating at a third free end, a fourth straight arm portion opposite the third straight arm portion, the fourth straight arm portion terminating at a fourth free end, and a second middle portion therebetween, the second middle portion connected to the base opposite the first flat plate;

(f) a top surface; and (g) a sole opposite the top surface, (h) wherein the first straight arm portion and the first curved arm portion define a first elongated gap therebetween;

(i) wherein the second straight arm portion and the third curved arm portion define a second elongated gap therebetween;

(j) wherein the third straight arm portion and the second curved arm portion define a third elongated gap therebetween; and (k) wherein the fourth straight arm portion and the fourth curved arm portion define a fourth elongated gap therebetween.

11. The golf putter of claim 10, (a) wherein the first curved contact surface, comprises:
(i) a first stabilization bar connecting the first terminal end on the first curved arm portion to the base, wherein the first elongated gap is defined by the first stabilization bar and the first straight arm portion, and (ii) a second stabilization bar connecting the second terminal end on the second curved arm portion to the base, wherein the third elongated gap is defined by the second stabilization bar and the third straight arm portion; and (b) wherein the second curved contact surface, comprises:

(i) a third stabilization bar connecting the third terminal end to the base, wherein the second elongated gap is defined by the third stabilization bar and the second straight arm portion, and (ii) a fourth stabilization bar connecting the fourth terminal end to the base, wherein the fourth elongated gap is defined by the fourth stabilization bar and the fourth straight arm portion.

12. The golf putter of claim 10, wherein a shaft is movably coupled to the base so that a user can use any of the contact faces.

13. The golf putter of claim 12, wherein the shaft is removably coupled to the base.

14. The golf putter of claim 13, further comprising an insert connected to the base, the insert comprising (a) a top orifice to receive the shaft, and (b) a fastener to secure the shaft into the top orifice.

15. The golf putter of claim 12, wherein the shaft is rotatably coupled to the base so that a golfer can rotate the shaft about a longitudinal axis perpendicular to the top surface to select a desired contact face for use.

16. The golf putter of claim 15, wherein the shaft is adjustably coupled to the top surface so that a golfer can toggle the shaft about a transverse axis perpendicular to the longitudinal axis from a first position to a second position.

17. The golf putter of claim 12, wherein the shaft is adjustably coupled to the top surface so that a golfer can toggle the shaft about a transverse axis perpendicular to the longitudinal axis from a first position to a second position.

* * * * *